US010794655B2

(12) United States Patent
Flood, Jr. et al.

(10) Patent No.: US 10,794,655 B2
(45) Date of Patent: Oct. 6, 2020

(54) BIPOD

(71) Applicant: WSM Manufacturing, LLC, Tualatin, OR (US)

(72) Inventors: Kenneth U. Flood, Jr., Wilsonville, OR (US); Jose Perales, Brooks, OR (US); Gary D. McGuire, Sweet Home, OR (US); Isaiah Caducoy, Newburg, OR (US)

(73) Assignee: WSM MANUFACTURING, LLC, Tualatin, OR (US)

( * ) Notice: Subject to any disclaimer, the term of this patent is extended or adjusted under 35 U.S.C. 154(b) by 0 days.

(21) Appl. No.: 16/439,655

(22) Filed: Jun. 12, 2019

(65) Prior Publication Data

US 2019/0293378 A1 Sep. 26, 2019

Related U.S. Application Data

(63) Continuation of application No. 15/854,151, filed on Dec. 26, 2017, now Pat. No. 10,408,555.

(60) Provisional application No. 62/446,382, filed on Jan. 14, 2017.

(51) Int. Cl.
*F41A 23/10* (2006.01)

(52) U.S. Cl.
CPC ..... *F41A 23/10* (2013.01)

(58) Field of Classification Search
CPC ..... F41A 23/04; F41A 23/06; F41A 23/08; F41A 23/10; F41A 23/12
See application file for complete search history.

(56) References Cited

U.S. PATENT DOCUMENTS

| | | | | |
|---|---|---|---|---|
| 3,235,997 | A * | 2/1966 | Stoner | F41A 23/08 42/94 |
| 3,327,422 | A | 6/1967 | Harris | |
| 3,445,082 | A * | 5/1969 | Frazer | F41A 23/08 248/183.3 |
| 5,711,103 | A * | 1/1998 | Keng | F41A 23/08 42/94 |

(Continued)

OTHER PUBLICATIONS

MIM Manufacturing, "RotaPod(R)," http://www.mim-mfg.com, (c) 2017, Accessed Oct. 11, 2017.

(Continued)

*Primary Examiner* — Joshua E Freeman
(74) *Attorney, Agent, or Firm* — Bennet K. Langlotz; Langlotz Patent & Trademark Works, LLC

(57) ABSTRACT

A bipod has a first frame portion, the first frame portion having a mounting facility adapted to connect to a firearm, a second frame portion connected to the first frame portion, at least a first leg connected to the second frame portion, the first frame portion and second frame portion being connected by way of a ball and socket joint, and the legs being movable with respect to the second frame portion between a stowed position in which they are adjacent the firearm and a deployed position in which they extend away from the firearm. The ball and socket joint may include at least one of the first and second frame portions having a ball element having a convex spherical surface portion, and the other of the first and second frame portions having a concave surface portion closely receiving the convex spherical surface portion to limit relative translational motion.

21 Claims, 12 Drawing Sheets

(56) References Cited

U.S. PATENT DOCUMENTS

| | | | | |
|---|---|---|---|---|
| 6,289,622 | B1 * | 9/2001 | Desch, Jr. | F41A 23/10 42/94 |
| 7,032,494 | B2 * | 4/2006 | Wygant | F41A 23/08 248/171 |
| 7,426,800 | B2 | 9/2008 | Pierce et al. | |
| 7,614,174 | B1 | 11/2009 | Beltz | |
| 7,823,316 | B2 | 11/2010 | Storch et al. | |
| 8,291,633 | B1 * | 10/2012 | Hass | F41A 23/10 42/72 |
| 9,581,403 | B2 * | 2/2017 | Hayes | F41A 23/08 |
| 2005/0242250 | A1 * | 11/2005 | Keng | F16M 11/26 248/168 |
| 2009/0126250 | A1 * | 5/2009 | Keng | F41A 23/10 42/94 |
| 2010/0005696 | A1 * | 1/2010 | Moody | F41C 23/16 42/94 |
| 2011/0126444 | A1 * | 6/2011 | Keng | F41A 23/10 42/94 |
| 2014/0115940 | A1 * | 5/2014 | Bonelli | F16M 11/38 42/94 |
| 2016/0265864 | A1 * | 9/2016 | Poling | F41A 23/10 |
| 2017/0205180 | A1 * | 7/2017 | Ding | F16M 11/247 |
| 2017/0299317 | A1 * | 10/2017 | Chen | F41A 23/10 |

OTHER PUBLICATIONS

Midwest Industries, Inc., "MI-QDAPM MI QD Mount for Aimpoint Pro and CompM4," https://www.midwestindustriesinc.com/MI-QD-Mount-for-Aimpoint-Pro-and-CompM4-p/mi-qdapm.htm, (c) 2014, Accessed Nov. 17, 2017.

* cited by examiner

FIG. 10A
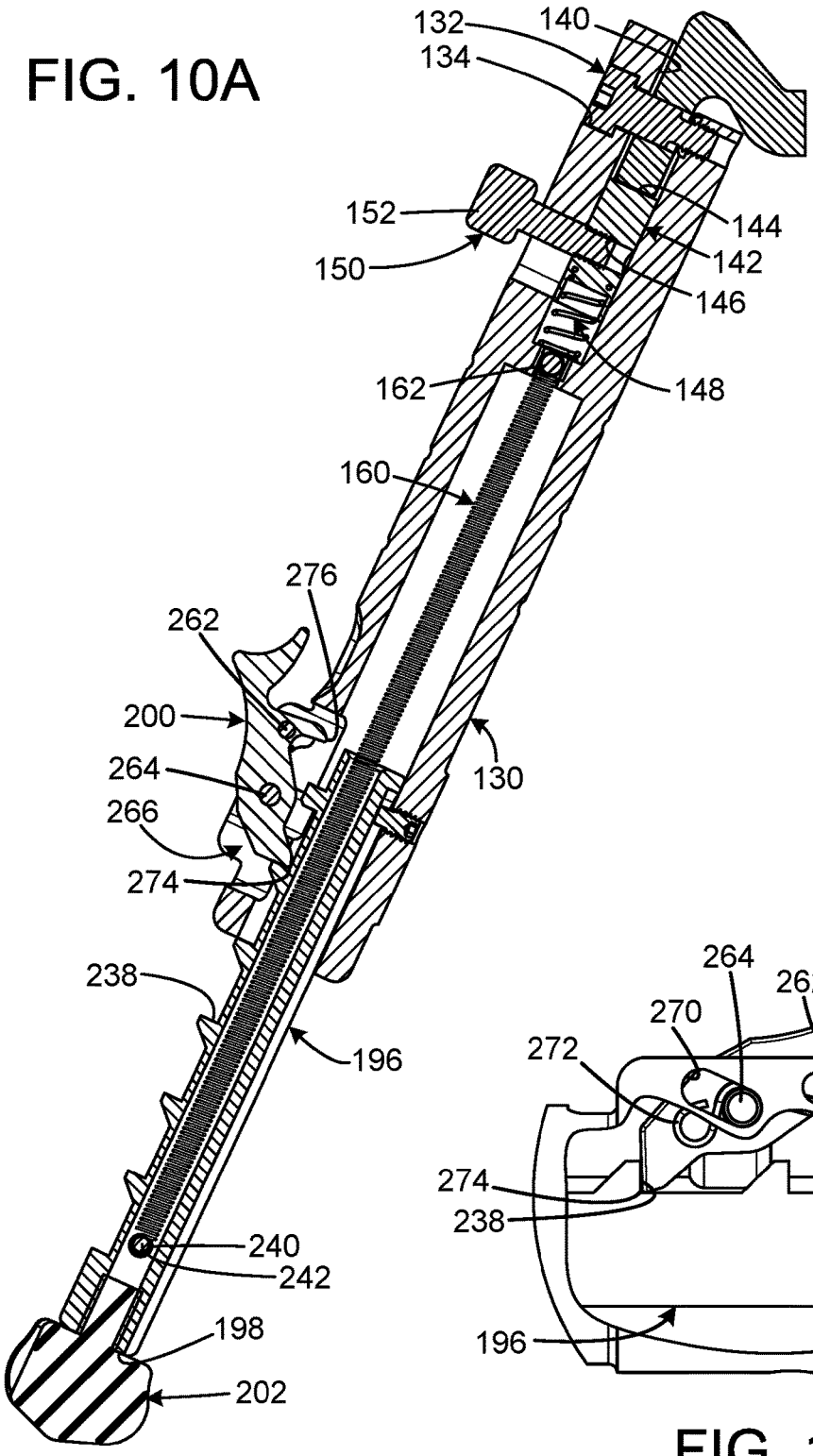
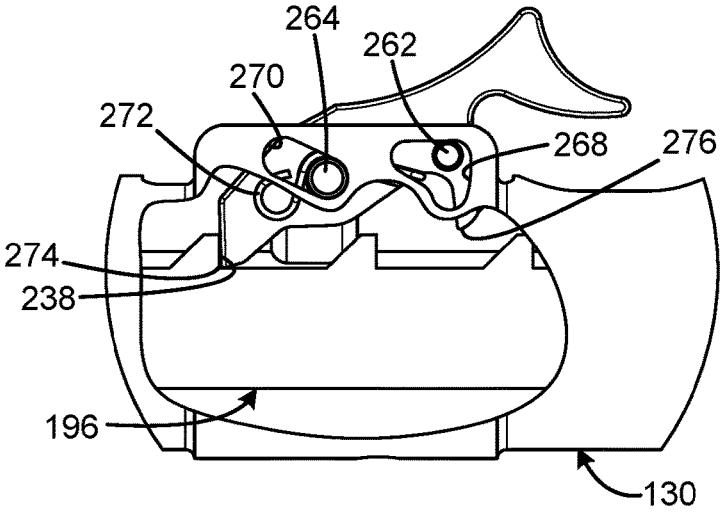
FIG. 10B

FIG. 12A
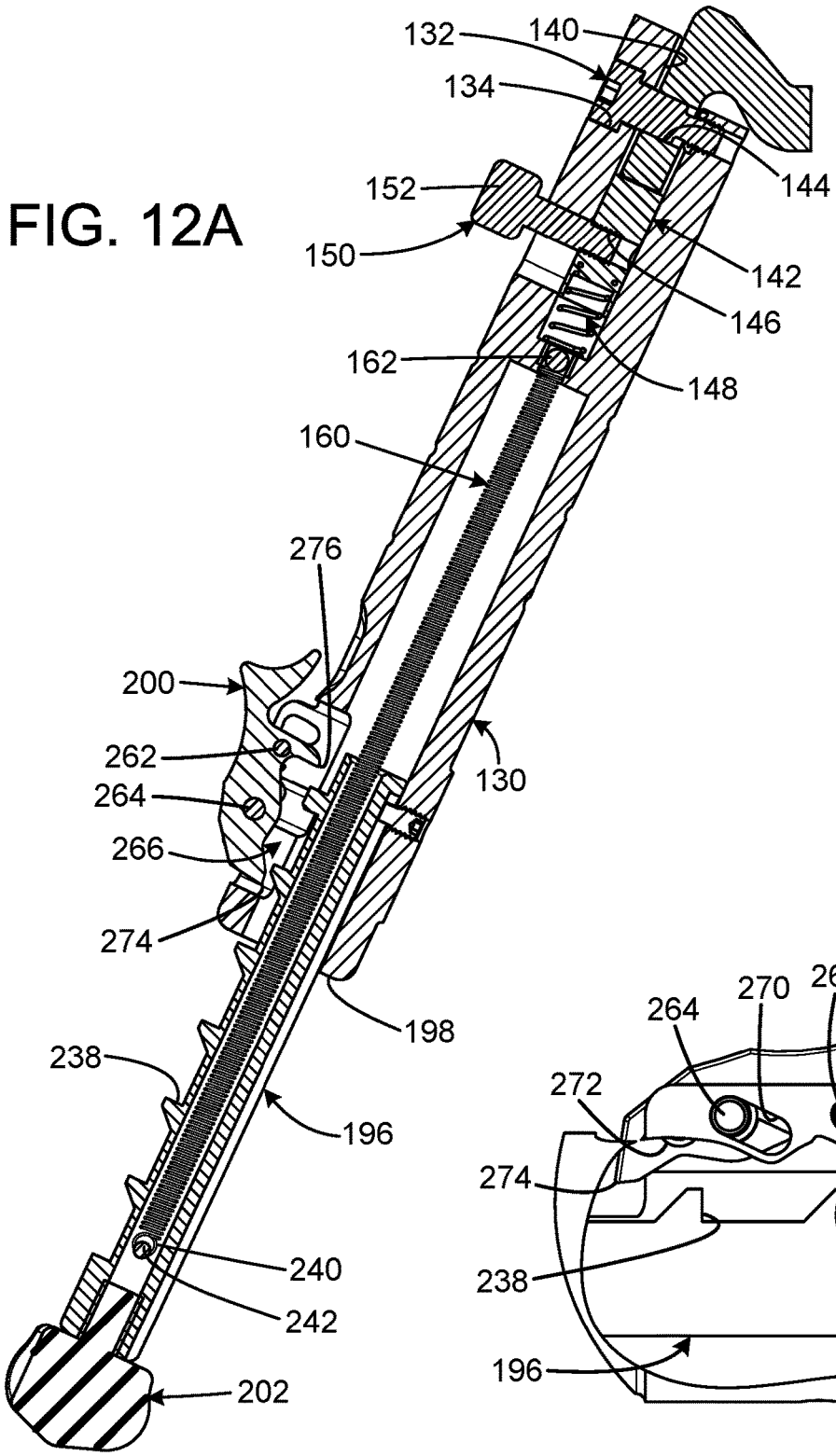
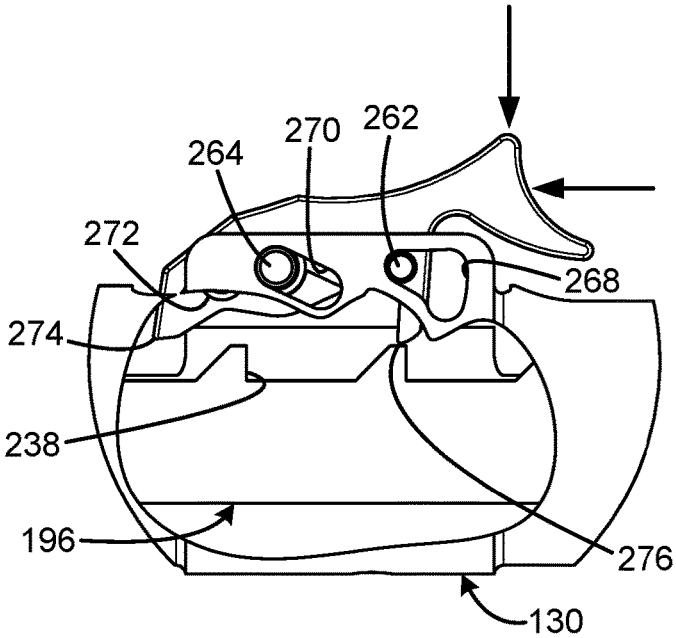
FIG. 12B

BIPOD

CROSS-REFERENCE TO RELATED APPLICATION

This application is a Continuation of U.S. patent application Ser. No. 15/854,151 filed on Dec. 26, 2017, entitled "BIPOD," which claims the benefit of U.S. Provisional Patent Application No. 62/446,382 filed on Jan. 14, 2017, entitled "PRECISION BIPOD," which are hereby incorporated by reference in their entirety for all that is taught and disclosed therein.

FIELD OF THE INVENTION

The present invention relates to firearms, and more particularly to a bipod that can function as a stand, a brace against the user's body, or a handle.

BACKGROUND OF THE INVENTION

A bipod is an attachment, usually to a firearm, that helps support and steady it. Bipods provide significant stability along two axes of motion (side-to-side, and up-and-down). On firearms, bipods are most frequently used on long-barreled weapons such as rifles and machine guns to provide a forward rest and reduce motion. Bipods enable shooters to easily rest their firearm on objects, like the ground or a wall, reducing their fatigue and increasing accuracy and stability. Bipods can also be useful to support the firearm when it is not being fired or is being cleaned. Some bipods have legs of a fixed length, while other bipods have length adjustable legs. Some can be tilted, with their tilting point close to the barrel's central axis, allowing the weapon to tilt left and right. The tilting capability enables the user to compensate for canting of the firearm that would otherwise occur if a shooter is shooting on the side of a hill. Some designs also allow the weapon to pan side-to-side. The legs of the bipod can be folded towards the shooter or away from the shooter when not in use.

Although the numerous conventional bipods with adjustable length legs are generally suitable for their intended use, they suffer from the disadvantages that they can require the manipulation of complex latching mechanisms to deploy the legs and/or to adjust the length of legs. The requirement for the shooter to manipulate complex latching mechanisms to deploy and lengthen the legs requires more time and requires more of the shooter's focus. This may result in the shooter missing an opportunity to shoot a game animal, enemy, or other target.

Therefore, a need exists for a new and improved bipod that enables the user to rapidly deploy and lengthen the legs. In this regard, the various embodiments of the present invention substantially fulfill at least some of these needs. In this respect, the bipod according to the present invention substantially departs from the conventional concepts and designs of the prior art, and in doing so provides an apparatus primarily developed for the purpose of enabling the user to rapidly deploy and lengthen the legs.

SUMMARY OF THE INVENTION

The present invention provides an improved bipod, and overcomes the above-mentioned disadvantages and drawbacks of the prior art. As such, the general purpose of the present invention, which will be described subsequently in greater detail, is to provide an improved bipod that has all the advantages of the prior art mentioned above.

To attain this, the preferred embodiment of the present invention essentially comprises a first frame portion, the first frame portion having a mounting facility adapted to connect to a firearm, a second frame portion connected to the first frame portion, at least a first leg connected to the second frame portion, the first frame portion and second frame portion being connected by way of a ball and socket joint, and the legs being movable with respect to the second frame portion between a stowed position in which they are adjacent the firearm and a deployed position in which they extend away from the firearm. The ball and socket joint may include at least one of the first and second frame portions having a ball element having a convex spherical surface portion, and the other of the first and second frame portions having a concave surface portion closely receiving the convex spherical surface portion to limit relative translational motion. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

FIG. 10A is a front sectional view of the support leg of FIG. 9 with the leg extension fully extended and the leg lever in manual mode in the at rest position.

FIG. 10B is an enlarged front cutaway view of the support leg of FIG. 9 with the leg lever in manual mode in the at rest position.

FIG. 12A is a front sectional view of the support leg of FIG. 9 with the leg extension fully extended and the leg lever in position for automatic mode.

FIG. 12B is an enlarged front cutaway view of the support leg of FIG. 9 with the leg lever in position for automatic mode.

The same reference numerals refer to the same parts throughout the various figures.

DESCRIPTION OF THE CURRENT EMBODIMENT

Figure 1:
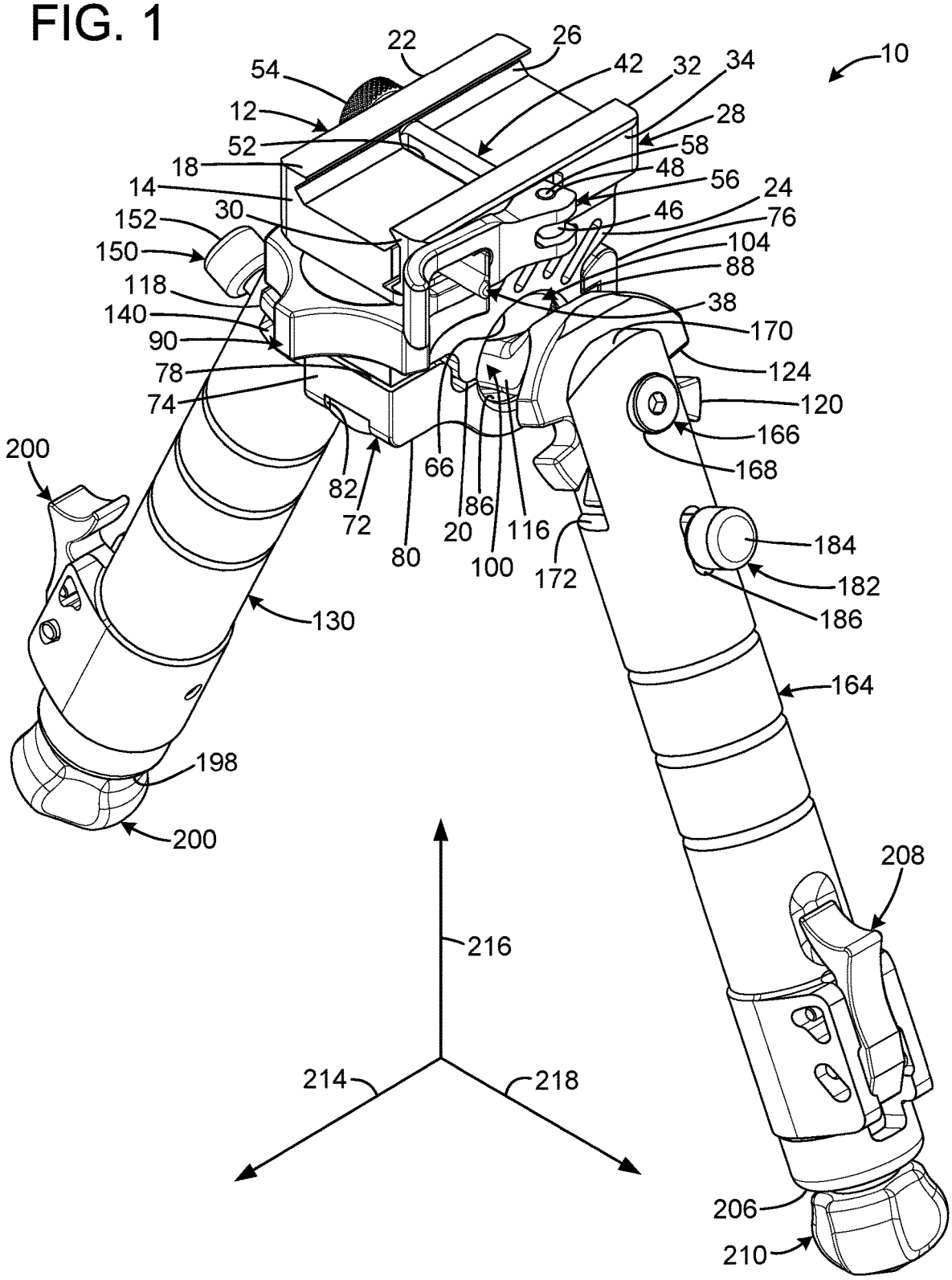
FIG. 1 is a top isometric view of the current embodiment of the bipod constructed in accordance with the principles of the present invention in a 90° deployed position.
Figure 2:
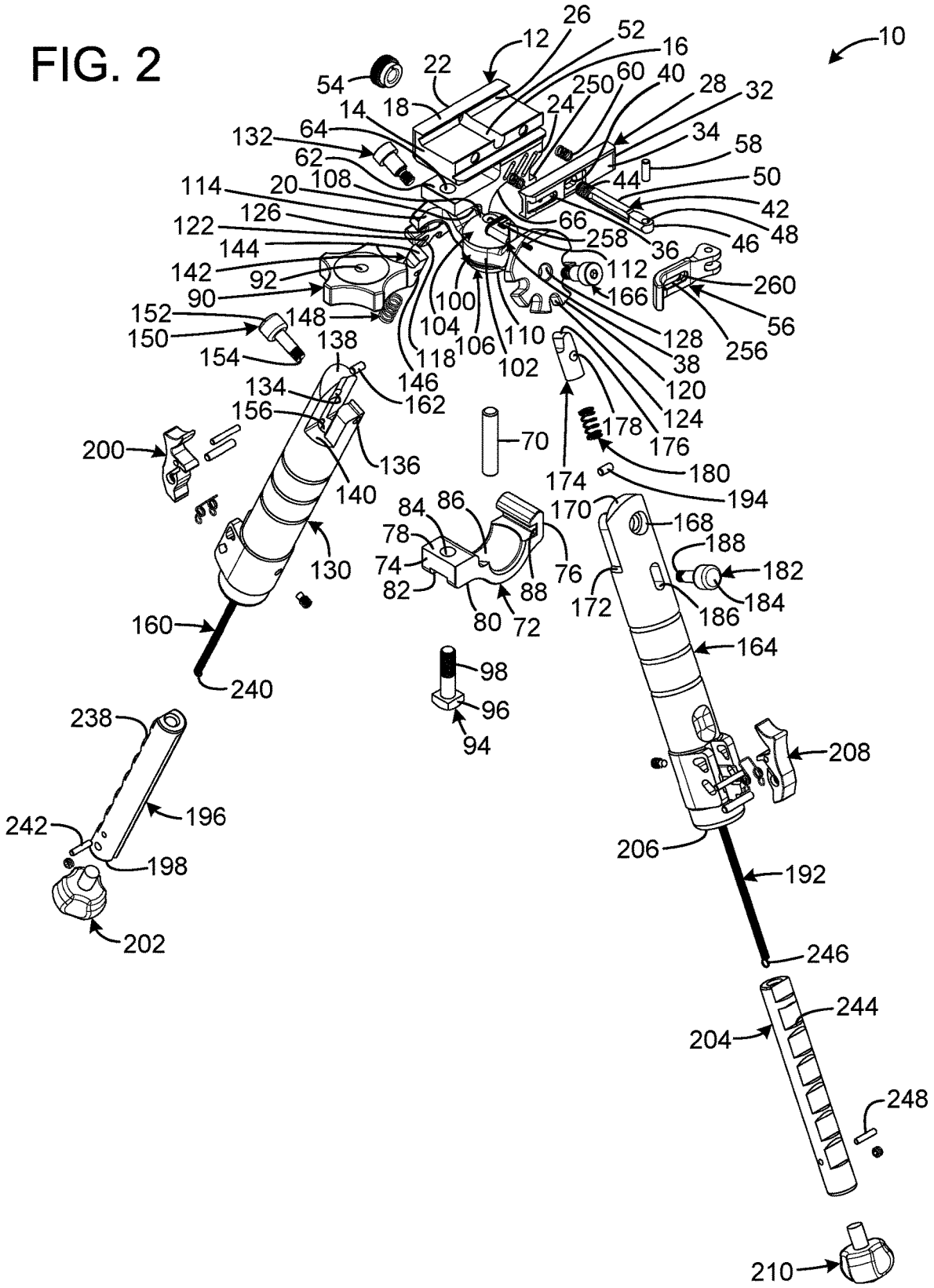
FIG. 2 is an exploded front isometric view of the current embodiment of the bipod of FIG. 1.

An embodiment of the bipod of the present invention is shown and generally designated by the reference numeral 10.

FIGS. 1-6 illustrate the improved bipod 10 of the present invention. More particularly, the bipod has a first frame portion/mount base 12 having a front 14, rear 16, top 18, bottom 20, right side 22, and left side 24. The top of the mount base includes an interface 26 to a Picatinny rail on a firearm. The left side of the mount base has an attached rail/mount clamp 28 that works in unison with the mount base as a mounting facility adapted to connect to a firearm to clamp the bipod onto the Picatinny rail. The mount clamp has a front 30, rear 32, and left side 34. The front left side of the mount clamp defines a slot 36 that receives a lever release 38. The middle of the mount clamp defines an aperture 40 that receives a cross bolt 42. The cross bolt has a threaded end 44 and an opposed end 46 that defines an aperture 48. The cross bolt is received by aperture 40 and has a top middle portion 50 that protrudes above a slot 52 defined by the interface. The top middle portion is sized and shaped to be closely received within a transverse slot in the Picatinny rail. The threaded end of the cross bolt receives a cross bolt end knob 54. The opposed end of the cross bolt is connected to a quick detach lever 56 by a pin 58. A coil spring 60 biases the mount clamp away from the mount base 12.

In the current embodiment, the lever release 38 is a spring-loaded part that holds the quick detach lever 56 in place when the quick detach lever is in the closed position. This is accomplished by inserting the lever release into a slot 256 in the quick detach lever such that a notch 258 in the lever release receives a tab 260 located within the slot of the quick detach lever. Release of the quick detach lever is a single-handed operation of pulling the lever release to disengage the tab from the notch, and then pushing on the quick detach lever to pivot the quick detach lever into the open position to quickly detach the bipod 10 from the firearm. Prior art quick release mechanisms require a push operation to release a quick release lever and a pull operation to pivot the quick release lever, which are difficult to perform with a single hand. The position of the mount clamp 28 relative to the mount base 12 is controlled by the quick detach lever. The extent to which the threaded end 44 of the cross bolt 42 is threaded into the cross bolt end knob 54 determines the clamping strength of the quick detach lever when the quick detach lever is in the closed position. The cross bolt end knob is finger adjustable and held in position by a detent in the right side of the mount base.

The front 14 of the mount base 12 defines a slot 62 and an aperture 64 in communication with the slot. A knob tighten wheel 90 having a central aperture 92 is partially received within the slot 62 such that the central aperture 92 is axially registered with aperture 64. The bottom 20 of the mount base defines a downward-facing spherical receptacle surface/hemispherical recess/concave surface portion 66 that includes a channel/slot 68 that receives one end 228 of a pin 70 (visible in FIG. 4). The bottom of the mount base also defines a rearward-facing dovetail 250.

A second frame portion/lower race block 72 is connected to the bottom 20 of the mount base 12. The lower race block has a front 74, rear 76, top 78, and bottom 80. The bottom front of the lower race block defines a square slot 82 in communication with an aperture 84. The bottom of the lower race block defines an upward-facing spherical receptacle surface/hemispherical recess/concave surface portion 86. The rear of the lower race block defines a forward-facing slot 88. When the lower race block is connected to the bottom of the mount base, the dovetail 250 is received within the slot 88. A steel square head bolt 94 has a head portion 96 received within the square slot, and the threaded portion 98 of the square head bolt passes through aperture 84, aperture 64, and aperture 92 and is threadedly received in aperture 230 (shown in FIG. 5) to secure a portion of the knob tighten wheel 90 within the slot 62 and to secure the top front of the lower race block against the bottom 20 front 14 of the mount base. The knob tighten wheel controls the clamping action of the lower race block against the mount base. Thus, the knob tighten wheel serves as an adjustable clamp facility to selectably fix the lower block race to the mount base.

A spider fighter 100 is clamped between the concave surface portion 66 of the mount base 12 and the concave surface portion 86 of the lower race block 72. The spider fighter has a central cylindrical portion 102 having a central aperture 224 (shown in FIG. 4). A sphere top 104 is attached to the top of the cylindrical portion, and a sphere bottom 106 is attached to the bottom of the cylindrical portion to collectively form a ball element. Therefore, the knob tighten wheel selectably biases the mount base and lower race block together to secure the ball element within the hemispherical recesses/concave surface portions. The sphere top and sphere bottom each have a convex surface 108, 110. The convex surfaces are sized and shaped to be closely received by the associated concave surface portions 66, 86 to create a ball and socket joint that limits relative translational motion. The sphere top has a central aperture 112 and the sphere bottom has a central aperture 226 (shown in FIG. 4) that are axially registered with each other and the central aperture of the cylindrical portion. The pin 70 is received within the central apertures of the sphere top, cylindrical portion, and sphere bottom. A top end of the pin 228 extends above the convex surface of the sphere top to be received within the slot 68 defined in the concave surface portion of the mount base. In the current embodiment, the sphere top and bottom are nylon hemispheres, and the pin is made of steel.

The spider fighter 100 includes a right arm 114 and a left arm 116 that are each have one end connected to the cylindrical portion 102. A right disc 118 is attached to the right arm, and a left disc 120 is attached to the left arm. The discs are planar elements that serve as opposed leg mounting facilities that define a right leg pivot axis 220 and a left leg pivot axis 222. Each of the discs defines a plurality of detent elements/slots 122, 124 along the bottom perimeter. In the current embodiment, there are five slots in each disc, and the slots are arrayed at 0°, 46°, 90°, 136°, and 180° relative to horizontal. The 0° and 180° positions are for stowing the right leg tube 180 and left leg tube 164 against the stock and barrel of an attached rifle. The 46°, 90°, and 136° positions provide one vertical and two intermediate angled deployed positions. In the current embodiment, the discs are angled at 25° relative to the centerline of the part. Each disc defines a central aperture 126, 128. In an alternative embodiment, the spider fighter can omit the chamfered/rounded edges shown.

A right leg tube 130 is pivotally attached to the right disc 118 by a right bolt 132 that is received by apertures 134, 136 in the top 138 of the right leg tube and aperture 126 in the right disc. A portion of the bottom perimeter of the right disc is received within a slot 140 in the top of the right leg tube. A right top leg latch 142 is received within the slot 140. The right top leg latch has an upper cam surface 144, an aperture 146, and is biased upward by a right leg latch spring 148. A right latch pin 150 has a head portion 152 extending outside of the right leg tube through a slot 234 (shown in FIG. 3) and a threaded end 154 that is received by aperture 146. When the right latch pin is depressed, the cam surface on the right top leg latch can move into one of the slots 122 to act as a latch facility to releasably secure the right leg tube in one of the plurality of allowed adjustment positions, each of which is associated with a slot. A central bore 156 communicates with the slot 140. The top end 158 of a right extension leg extension spring 160 extends above the central bore. A pin 162 prevents the top end of the right extension leg extension spring from being pulled down into the central bore. In an alternative embodiment, the right bolt 132 can be longer than illustrated.

Figure 3:
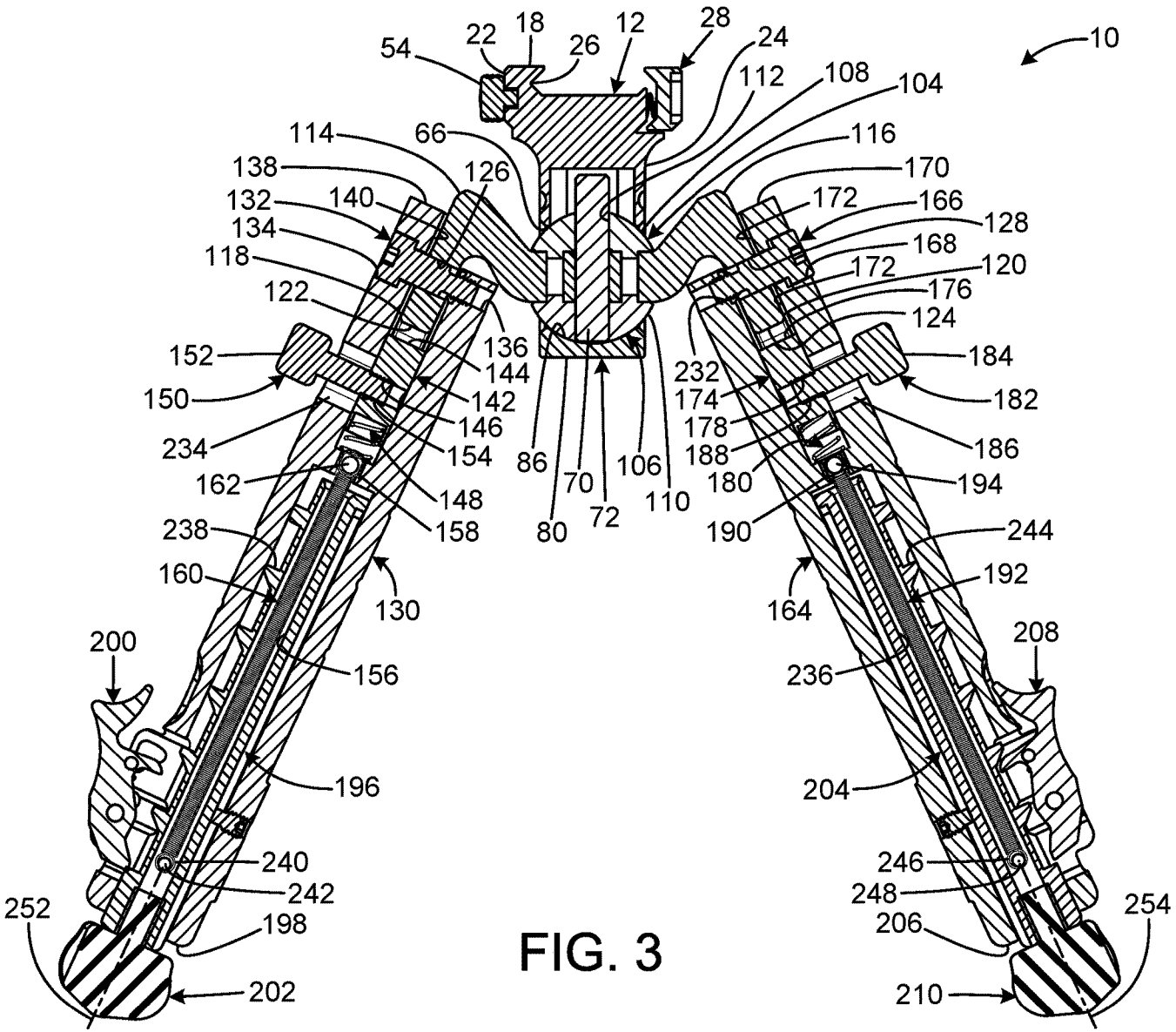
FIG. 3 is a front sectional view of the current embodiment of the bipod of FIG. 1.
Figure 4:
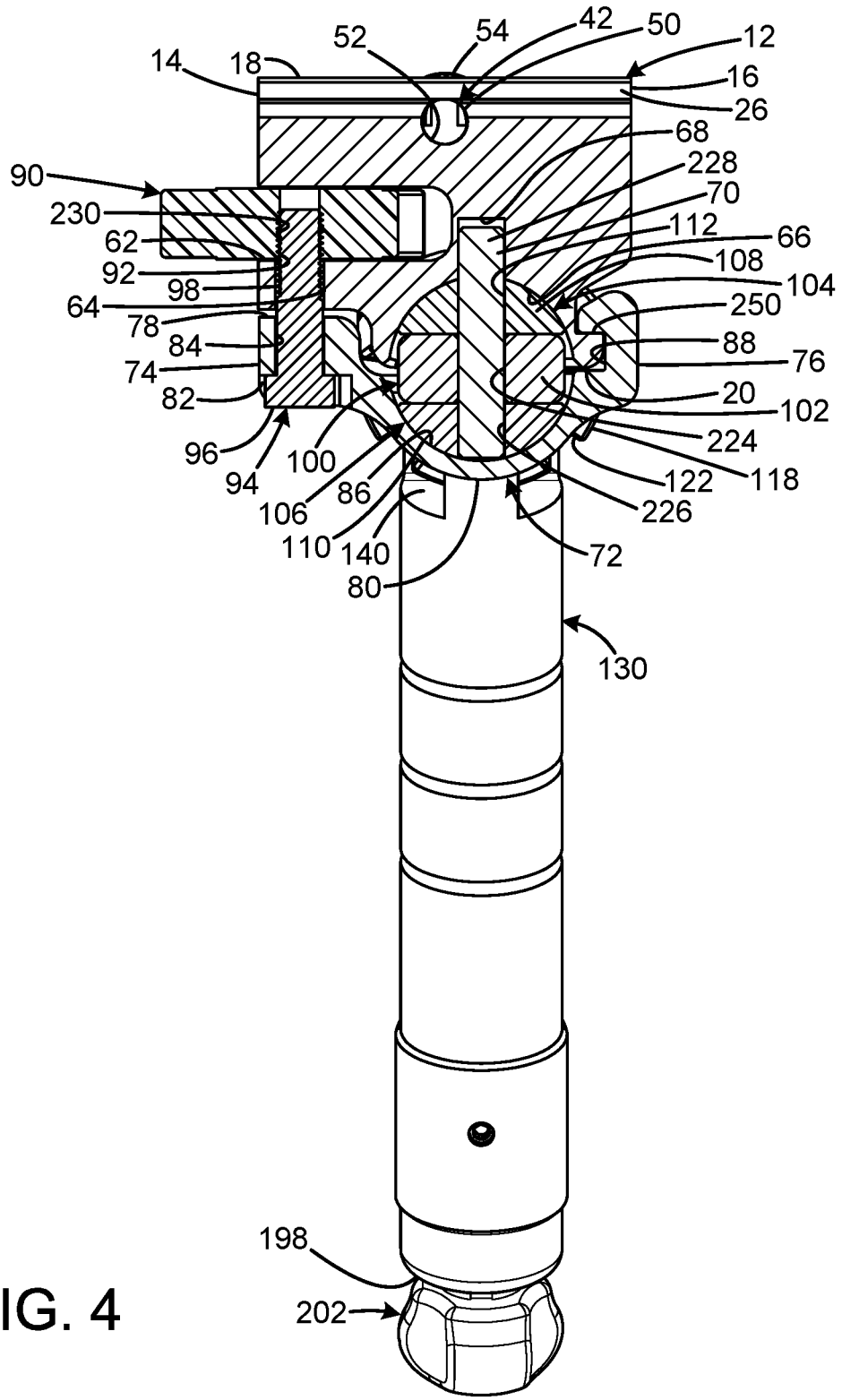
FIG. 4 is a side sectional view of the current embodiment of the bipod of FIG. 1.
Figure 5:
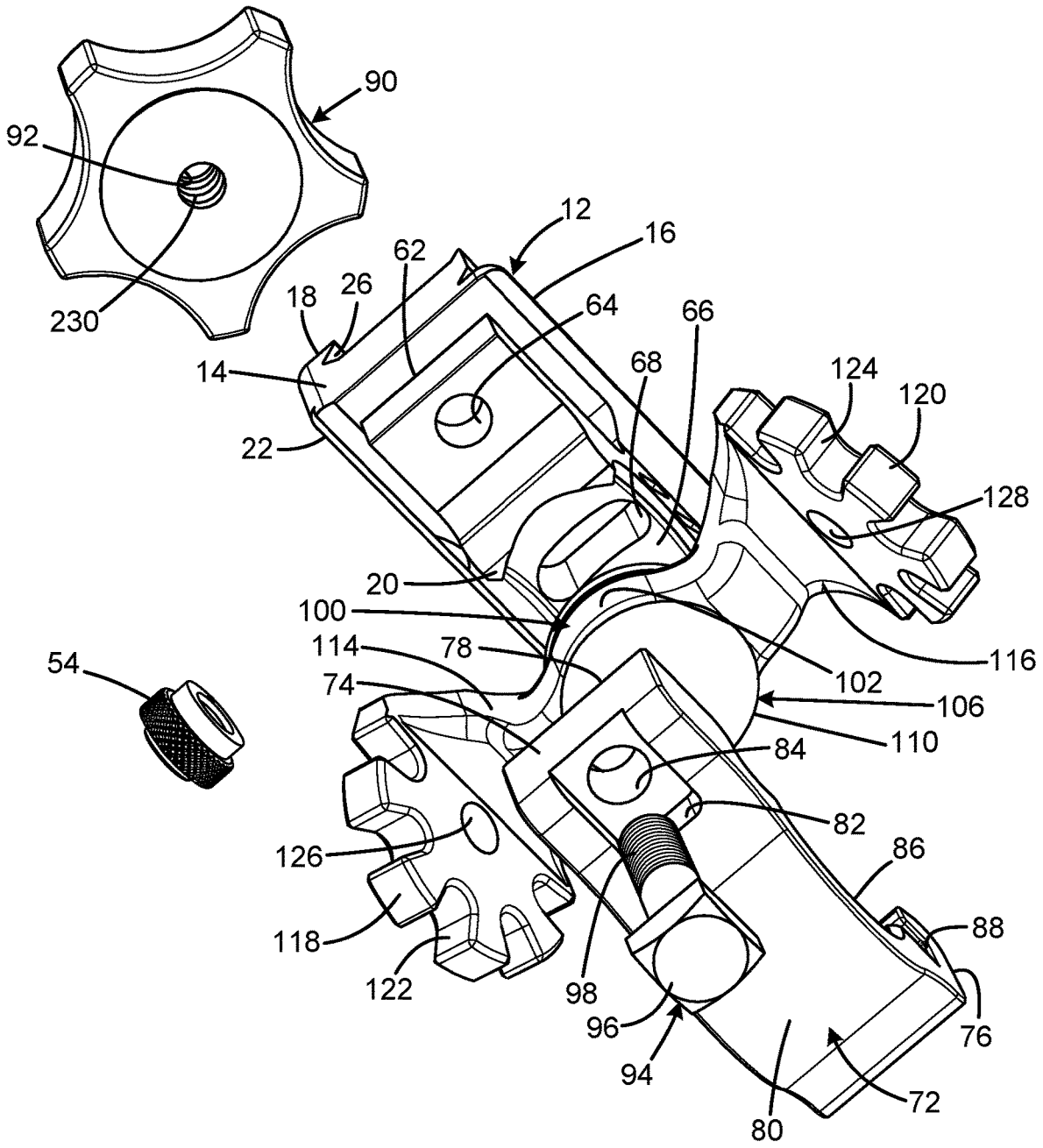
FIG. 5 is a bottom isometric view of the mount base of the bipod of FIG. 1.
Figure 6:
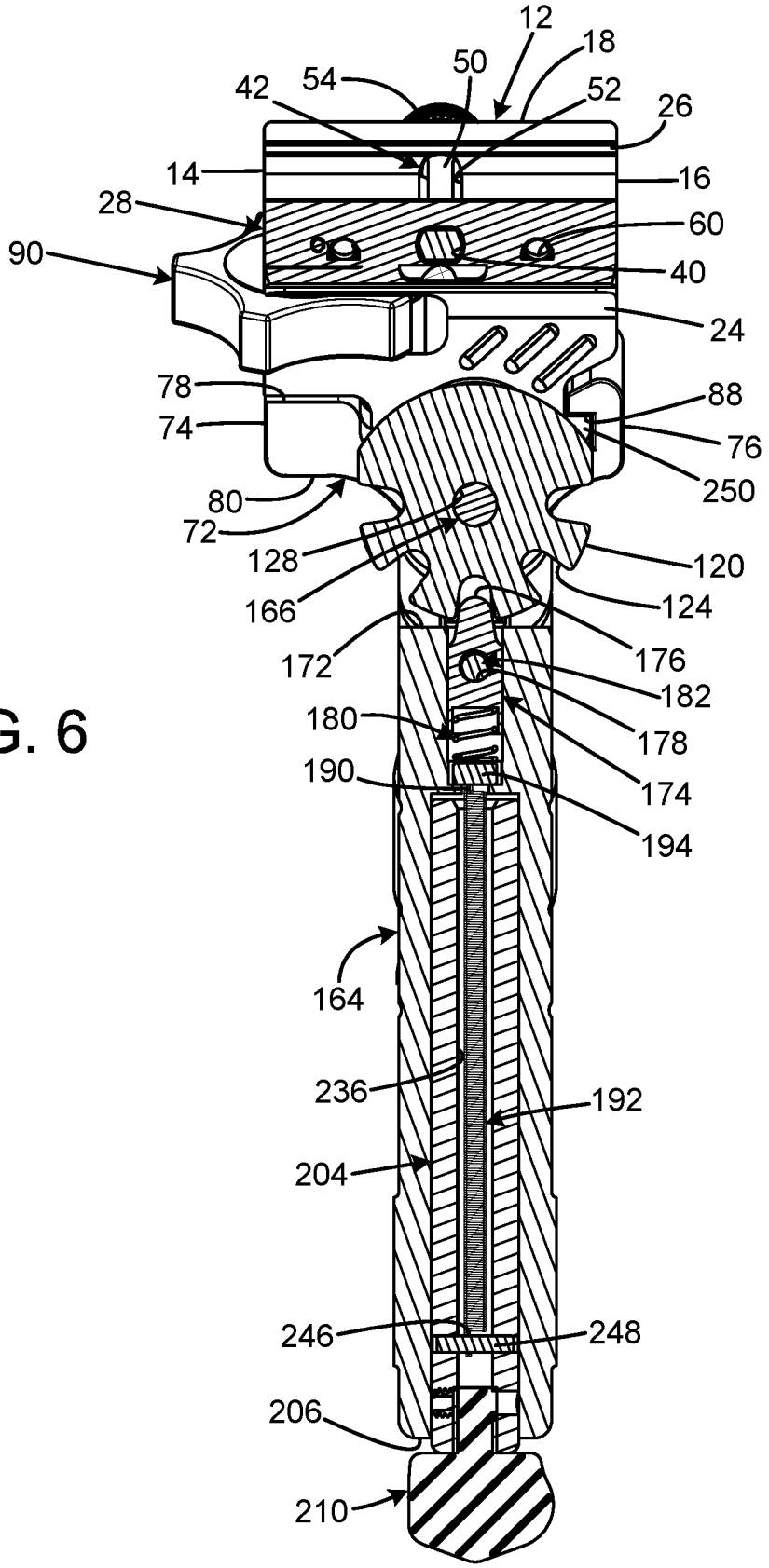
FIG. 6 is a side sectional view of a support leg of the bipod of FIG. 1.

A left leg tube 164 is pivotally attached to the left disc 120 by a left bolt 166 that is received by apertures 168, 232 (aperture 232 is shown in FIG. 3) in the top 170 of the right leg tube and aperture 128 in the left disc. A portion of the bottom perimeter of the left disc is received within a slot 172 in the top of the left leg tube. A left top leg latch 174 is received within the slot 172. The left top leg latch has an upper cam surface 176, an aperture 178, and is biased upward by a left leg latch spring 180. A left latch pin 182 has a head portion 184 extending outside of the left leg tube through a slot 186 and a threaded end 188 that is received by aperture 178. When the left latch pin is depressed, the cam surface on the left top leg latch can move into one of the slots 124 to act as a latch facility to releasably secure the left leg tube in one of the plurality of allowed adjustment positions, each of which is associated with a slot. A central bore 236 (shown in FIG. 3) communicates with the slot 172. The top end 190 of a left extension leg extension spring 192 extends above the central bore. A pin 194 prevents the top end of the left extension leg extension spring from being pulled down into the central bore. In an alternative embodiment, the left bolt 166 can be longer than illustrated.

A right extension leg 196 extends out of the bottom 198 of the right leg tube 130 and defines a right leg axis 252. An adjustable portion of the right extension leg extends from the bottom of the right leg tube for length adjustment. Movement of the right extension leg is controlled by a spring-loaded right leg lever 200. The right extension leg terminates in a removable right rubber foot 202 for contact with hard surfaces. The right extension leg can be withdrawn from the bottom of the right leg tube by pulling downward on the right extension leg. The right leg lever interacts with steps 238 on the right extension leg to provide a ratcheting action. The right extension leg can be retracted into the bottom of the right leg tube by pushing the right leg lever towards the right foot and pushing the right leg tube downward onto the right extension leg. The right extension leg is attached to the bottom 240 of the right extension leg extension spring 160 by a pin 242 and has six steps/stop points in the current embodiment. In the current embodiment, an interchangeable stainless-steel foot (not shown) with a spike and washer for use on soft surfaces can be substituted for the right rubber foot.

A left extension leg 204 extends out of the bottom 206 of the left leg tube 164 and defines a left leg axis 254. An adjustable portion of the right extension leg extends from the bottom of the left leg tube for length adjustment. Movement of the left extension leg is controlled by a spring-loaded left leg lever 208. The left extension leg terminates in a removable left rubber foot 210 for contact with hard surfaces. The left extension leg can be withdrawn from the bottom of the left leg tube by pulling downward on the left extension leg. The left leg lever interacts with steps 244 on the left extension leg to provide a ratcheting action. The left extension leg can be retracted into the bottom of the left leg tube by pushing the left leg lever towards the left foot and pushing the left leg tube downward onto the left extension leg. The left extension leg is attached to the bottom 246 of the left extension leg extension spring 192 by a pin 248 and has six steps/stop points in the current embodiment. In the current embodiment, an interchangeable stainless-steel foot (not shown) with a spike and washer for use on soft surfaces can be substituted for the left rubber foot.

The right leg lever 200 and the left leg lever 208 interact with the right extension leg 196 having steps 238 and the left extension leg 204 having steps 244 to provide two distinct modes of unlatched operation. The first mode retracts a selected extension leg one step at a time when the associated leg lever is pressed in the direction perpendicular to the associated leg axis 252, 254. The second mode fully retracts the selected extension leg in one motion by bypassing the individual steps of a selected extension leg. To enter the second mode, a selected leg lever is pressed perpendicularly to the associated leg axis and pushed downward along the associated leg axis. In either mode of unlatched operation, the selected leg lever releasably secures the associated extension leg into its current position when the selected leg lever is released and returned by its spring to the latched position.

Figure 7:
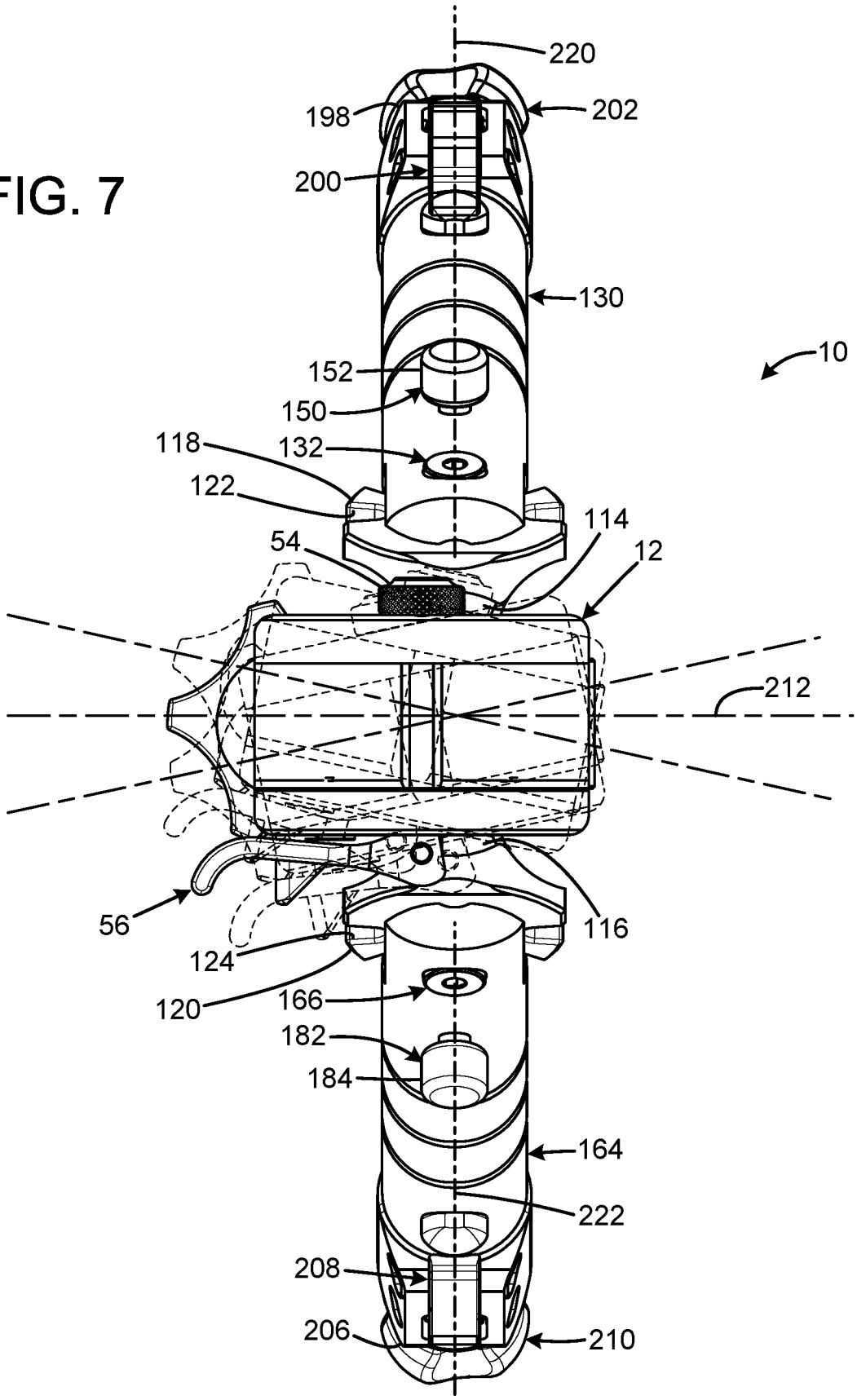
FIG. 7 is a top view of the bipod of FIG. 1 showing the range of motion of the mount base when panning.
Figure 8:
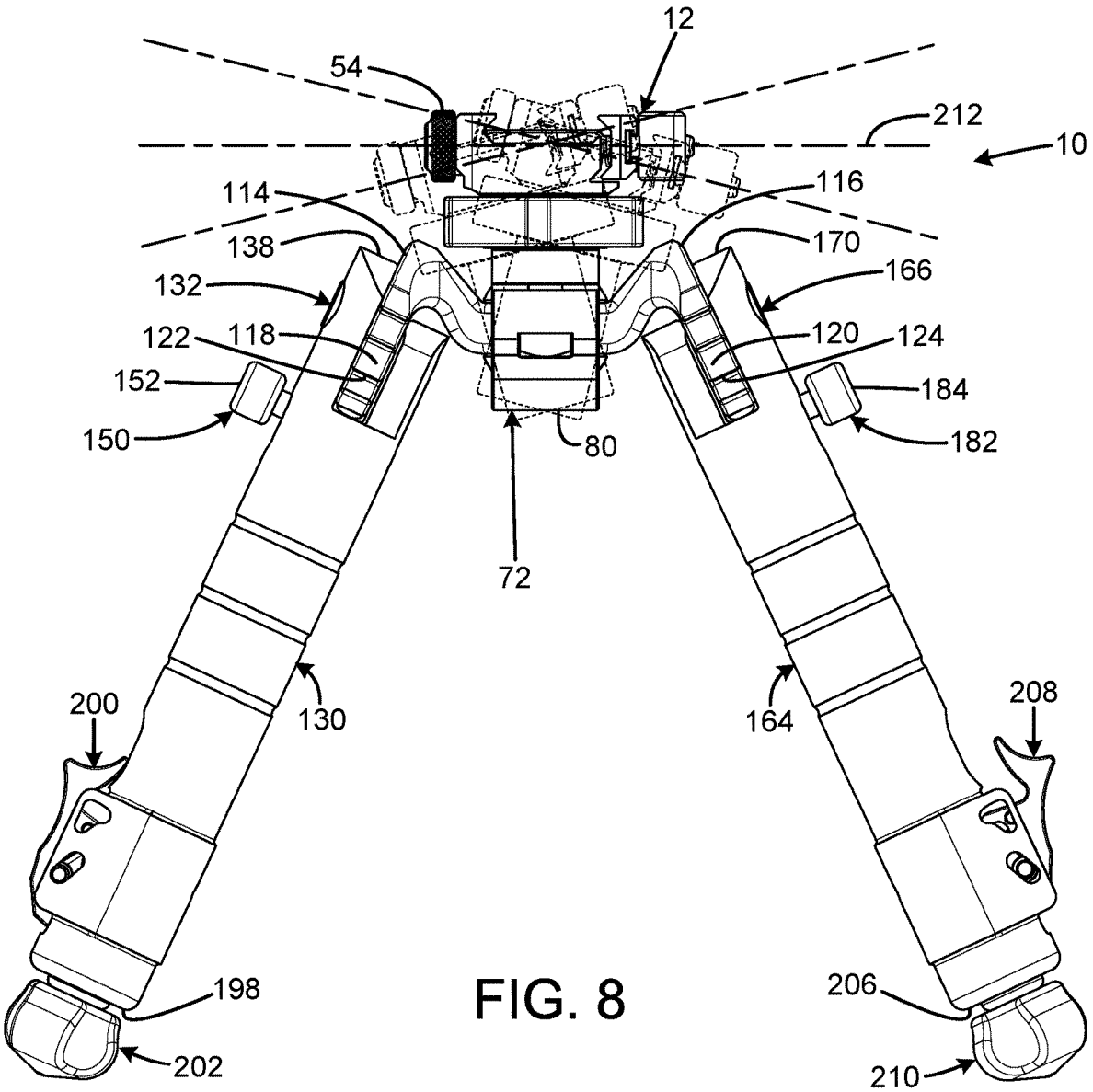
FIG. 8 is a front view of the current embodiment of the bipod of FIG. 1 showing the range of motion of the mount base when tilting.
Figure 9:
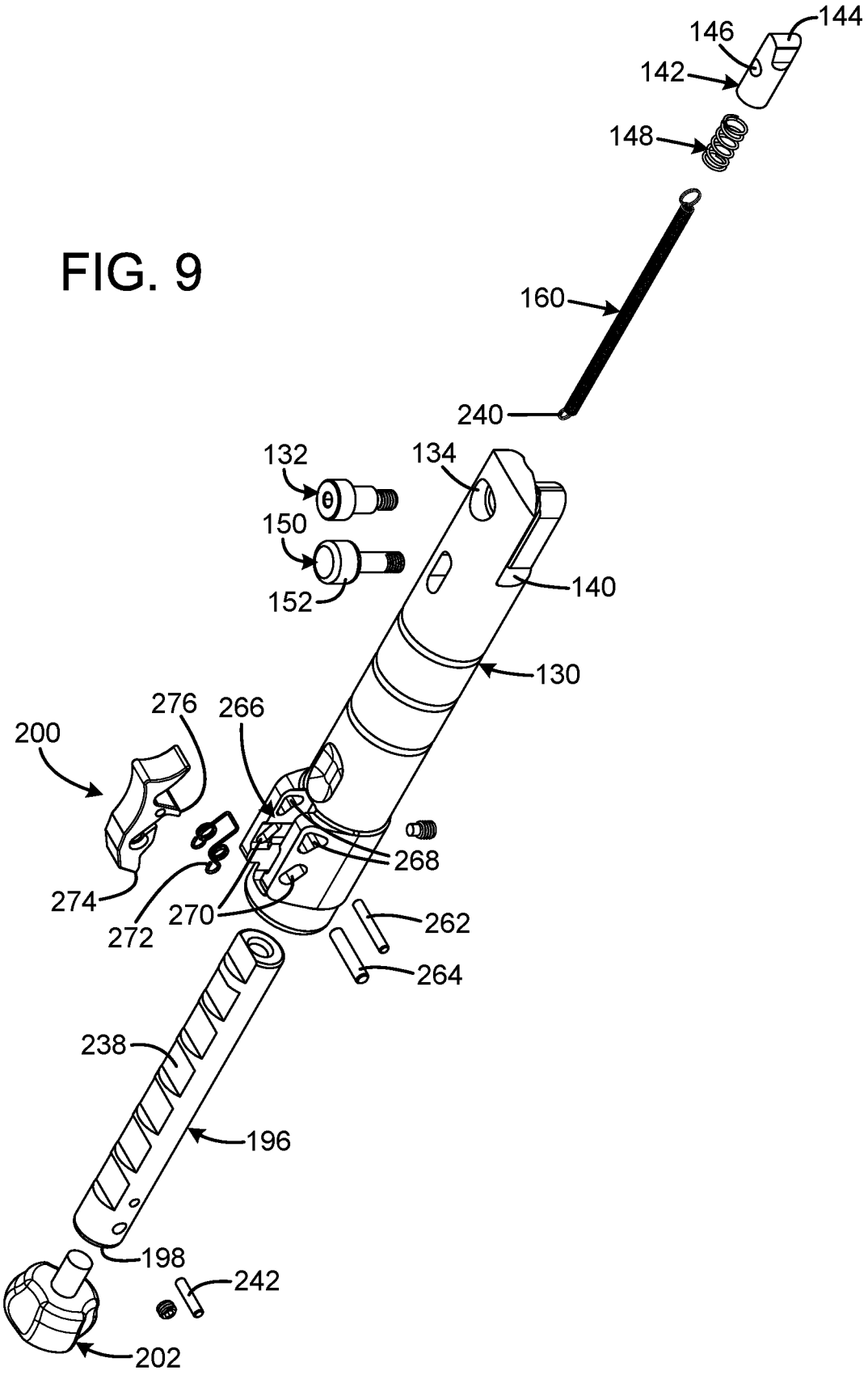
FIG. 9 is an exploded view of a support leg of the bipod of FIG. 1.
Figure 11:
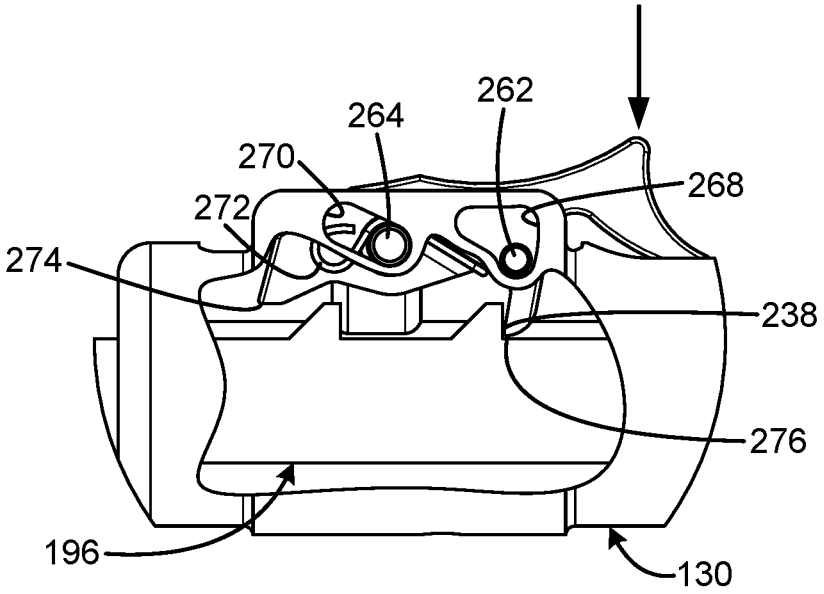
FIG. 11 is an enlarged front cutaway view of the support leg of FIG. 9 with the leg lever in manual mode in the depressed position.

FIGS. 7 and 8 illustrate the improved bipod 10 of the present invention. More particularly, FIG. 7 illustrates the range of motion of the mount base 12 and lower race block 72 when panning. FIG. 8 illustrates the range of motion of the mount base and lower race block when tilting. The panning capability enables an attached firearm to be moved from one target to another without having to reposition the bipod. The tilting capability enables an attached firearm to remain level even when the bipod is on uneven terrain without requiring length adjustment of the legs. The ball and socket joint resulting from the capture of the ball element consisting of the sphere top 104, sphere bottom 106, and cylindrical portion 102 of the spider fighter 100 within the concave surface portions 66, 86 enables smooth movement of the mount base and lower race block for panning and tilting movements. The mount base and lower race block can be panned up to 12° to the left or right of center in the current embodiment. The mount base and lower race block can be tilted up to 15° to the left or right of vertical in the current embodiment. The amount of force required to pan or tilt the mount base and lower race block is determined by the strength of the clamping action between the mount base and the lower race block. The knob tighten wheel 90 is rotated to adjust the strength of the clamping action between the mount base in the lower race block. The top end of the pin 70 indexes into the slot 68 in the concave surface portion of the mount base to prevent front to rear movement of the spider fighter and to only permit tilting and panning movement of the spider fighter. The slot is transverse to a medial vertical plane 212 defined by an attached firearm and limits forward and aft movement of the leg tubes 130, 164. The concave surface portions 66, 86 and slot 68 together serve as a rotational constraint facility to provide a selected range of rotational motion about a first axis 214, a second selected range of motion about a second axis 216 perpendicular to the first axis, and to prevent motion about a third axis 218 perpendicular to the first and second axes. In the current embodiment, the selected range of motion about the first axis is ±15° and about the second axis is ±12°. The third axis is perpendicular to the medial vertical plane.

FIGS. 9-12 illustrate the function of the leg levers 200, 208 in more detail. More particularly, although the right leg tube 130, right leg lever 200, and right extension leg 196 are shown and described, the left leg tube 164, left leg lever 208, and left extension leg 204 function in an identical manner.

To transition the right leg extension 196 from the fully collapsed position shown in FIGS. 3, 4, and 6-8, the right leg extension is pulled out in a ratchet fashion as the right leg lever 200 clocks over each step 238 as long as the right leg extension is pulled, to the desired intermediate length, or the fully extended position shown in FIGS. 10A and 12A. In an extended position, the bottom 274 of the right leg lever engages a desired step 238 to prevent the right extension leg extension spring 160 from pulling the right leg extension upward into the right leg tube 130. This position of the right leg lever is referred to as manual mode at rest, and is illustrated in FIGS. 10A and 10B. To retract the right leg extension in a step wise manner, the right leg lever acts as a clockmaker's escapement mechanism in which the right leg lever pivots about the lower control pin 264 in a perpendicular movement lateral to the right leg axis 252 to the extent permitted by the limited inward movement of the upper control pin 262 within upper control aperture 268 upon application of force denoted by the arrow in FIG. 11. This movement transitions the right leg lever to a position referred to as manual mode depressed. In this position, shown in FIG. 11, the bottom of the right leg lever releases the step, and the right extension leg is permitted to retract upward as urged by the right extension leg extension spring until a step contacts an upper tooth 276 on the right leg lever that is spaced apart from the bottom of the right leg lever. If the right leg lever is released so the leg lever spring 272 can return the right leg lever to the manual mode at rest position, the upper tooth releases the step, and the right extension leg is permitted to further retract upward as urged by the right extension leg extension spring until the next step contacts the bottom of the right leg lever. Thus, a single step increment of retraction of the right extension leg is achieved by a single cycle of press-release of the right leg lever using the lower control pin located between the bottom and upper tooth of the right leg lever as a fulcrum to alternate engagement of the bottom and upper tooth with the steps and retraction of the bottom and upper tooth.

When the right leg lever 200 is pressed in a different direction, the right extension leg will retract completely during the single press. This position is referred to as automatic mode. In this position, shown in FIGS. 12A and 12B, the right leg lever transitions from manual mode at rest to automatic mode upon application of force in the locations and directions denoted by the arrows in FIG. 12B. In automatic mode, the upper and lower control pins 262, 264, which are spaced apart, have slid downward along the right leg axis 252 and, in the case of the lower control pin, outward perpendicularly to the right leg axis within their corresponding upper and lower control apertures 268, 270. This is a different direction of motion from the inward pivoting motion of the right leg lever to the manual mode depressed position. In the automatic mode position, neither the bottom 274 nor the upper tooth 276 of the right leg lever are positioned to engage any of the steps 238, thus enabling the right extension leg extension spring 160 to completely retract the right leg extension within the right leg tube with one press of the right leg lever. The three positions available to the right leg lever give the operator the ability to either incrementally reduce the height of a selected leg of the bipod 10 one increment at a time, or to completely retract a selected leg with one press of the right leg lever.

While current embodiments of a bipod have been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A firearm support comprising:

a first leg portion having a first end and an opposed second end;

the first end including a connection facility adapted to supportably connect to the firearm;

a second leg portion telescopically connected to extend from the second end of the first leg portion and movable over a sequential range of positions between a retracted position, a fully extended position, and a plurality of intermediate positions;

a ratchet element interconnecting the first and second elongated bodies; and wherein the ratchet element has a first operational mode to retract the second leg portion by a single increment to an adjacent more retracted position upon a first actuation of the ratchet element irrespective of duration of actuation, and to fully retract the leg to the retracted position by a different second actuation of the ratchet element.

2. The firearm support of claim 1 wherein the ratchet mechanism is configured to enable the second leg portion to be extended by pulling the second leg portion away from the first leg portion, and to resist retraction of the second leg portion.

3. The firearm support of claim 2 wherein the ratchet mechanism includes a ratchet element movable between a first rest position in which the second leg portion is restrained against retraction, and a second actuated position in which the second leg portion is enabled for retraction by an increment upon release of the ratchet element, such that one cycle of the ratchet element from the first rest position to the second actuated position and back to the first rest position increments the second leg portion to a single increment toward the retracted position.

4. The firearm support of claim 3 wherein at least one of the first and second leg elements includes a plurality of stop elements each corresponding to each of the intermediate positions.

5. The firearm support of claim 4 wherein the ratchet element has a first catch configured to engage a selected stop element when the ratchet element is in the first rest position, and a second catch configured to engage a selected stop element when the ratchet element is in the second actuated position.

6. The firearm support of claim 5 wherein the ratchet element has a third release position in which both catches are disengaged from the stop elements to enable the second leg element to be unrestrained and retract to the retracted position.

7. The firearm support of claim 1 wherein the first leg portion defines a bore, and a portion of the second leg portion is telescopically received in the bore.

8. The firearm support of claim 1 wherein the ratchet mechanism includes a ratchet element pivotally connected to the first leg element.

9. The firearm support of claim 1 wherein the second leg portion includes a plurality of catch elements along its length configured to be engaged by the ratchet mechanism.

10. The firearm support of claim 1 wherein the ratchet mechanism has a rest configuration configured to enable extension of the leg by application of an extension force on the second leg portion, and to resist retraction of the leg in response to compressive force on the leg.

11. The firearm support of claim 1 wherein the second leg portion is spring biased toward the retracted position.

12. The firearm support of claim 1 wherein the second leg portion is spring biased with respect to the first leg portion.

13. The firearm support of claim 1 wherein the ratchet mechanism is configured to enable the second leg portion to be displaced relative to the first leg portion by applying an external force to the second leg portion, and to resist movement of the second leg portion.

14. A firearm support comprising: a first leg portion having a first end and an opposed second end; the first end including a connection facility adapted to supportably connect to the firearm; a second leg portion telescopically connected to extend from the second end of the first leg portion and movable over a sequential range of positions between a retracted position, a fully extended position, and a plurality of intermediate positions; the second leg portion being spring biased toward the retracted position; a ratchet element interconnecting the first and second elongated bodies, wherein the ratchet element has a first operational mode to retract the second leg portion by a single increment to an adjacent more retracted position upon a first actuation of the ratchet element, and to fully retract the leg to the retracted position by a different second actuation of the ratchet element, wherein the first actuation is in one direction and the second actuation is in a different second direction.

15. The firearm support of claim 14 wherein the first actuation is perpendicular to the leg and the second actuation is along the leg.

16. A firearm support comprising:

a first leg portion having a first end and an opposed second end, the first end including a connection facility adapted to supportably connect to the firearm;

a second leg portion telescopically connected to extend from the second end of the first leg portion and movable over a sequential range of positions between a retracted position, a fully extended position, and a plurality of intermediate positions;

a ratchet element interconnecting the first and second elongated bodies; and wherein the ratchet element includes a ratchet lever pivotally connected to the first leg portion at a first pivot pin seated at a first location, and wherein the first pivot pin is movable to a second location to fully retract the leg.

17. The firearm support of claim 16 wherein the first leg portion defines a slot receiving the first pivot pin.

18. The firearm support of claim 16 wherein the ratchet element includes a second pin received in an aperture enabling the second pin a first range of motion in a first direction, and a second range of motion in a second direction.

19. A firearm support comprising: a first leg portion having a first end and an opposed second end; the first end including a connection facility adapted to supportably connect to the firearm; a second leg portion telescopically connected to extend from the second end of the first leg portion and movable over a sequential range of positions between a retracted position, a fully extended position, a plurality of intermediate positions; and an escapement mechanism interconnecting the first and second elongated bodies, wherein the escapement mechanism includes an actuator having a first catch and a second catch, the actuator movable between a first position in which the first catch restrains the second leg portion and a second position in which the second catch restrains the second leg portion, and wherein the actuator is movable to a third position in which neither of the first and second catch restrains the second leg portion.

20. The firearm support of claim 19 wherein the escapement mechanism is operable in response to a single extended application and release of pressure to move the second portion of the leg from one of the sequential range of positions to an adjacent one of the sequential range of positions.

21. The firearm support of claim 19 including a ratchet enabling the second leg portion to be extended without actuation of the escapement mechanism.

* * * * *